US006729864B2

(12) United States Patent
Eley

(10) Patent No.: US 6,729,864 B2
(45) Date of Patent: May 4, 2004

(54) ROTARY POSITIVE DISPLACEMENT MACHINE

(75) Inventor: Ann Margaret Eley, South Croydon (GB)

(73) Assignee: E. A. Technical Services Limited, Lancahire (GB)

( * ) Notice: Subject to any disclaimer, the term of this patent is extended or adjusted under 35 U.S.C. 154(b) by 0 days.

(21) Appl. No.: 10/332,382

(22) PCT Filed: Jul. 9, 2001

(86) PCT No.: PCT/GB01/03089

§ 371 (c)(1),
(2), (4) Date: Jan. 8, 2003

(87) PCT Pub. No.: WO02/04814

PCT Pub. Date: Jan. 17, 2002

(65) Prior Publication Data

US 2003/0156962 A1 Aug. 21, 2003

(30) Foreign Application Priority Data

Jul. 10, 2000 (GB) ..... 0016761
Jan. 25, 2001 (GB) ..... 101960

(51) Int. Cl.[7] ..... F03C 2/00

(52) U.S. Cl. ..... 418/247; 418/243; 418/183; 123/235

(58) Field of Search ..... 418/247, 243, 418/240, 183; 123/235

(56) References Cited

U.S. PATENT DOCUMENTS 154,298 A * 8/1874 Teal ..... 418/247
1,698,815 A 1/1929 Jaworowski
2,425,244 A * 8/1947 Jeffries ..... 418/240
3,895,609 A 7/1975 Armstrong
4,023,540 A * 5/1977 Zollenkopf ..... 123/240
5,713,732 A * 2/1998 Riney ..... 418/247

FOREIGN PATENT DOCUMENTS

DE 43 20 423 A1 6/1993
GB 381886 10/1932
GB 382567 10/1932
GB 390443 4/1933

OTHER PUBLICATIONS

International Search Report for International Application No. PCT/GB01/03089, dated Oct. 3, 2001.
Search Report under Section 17 of Patents Act 1977, by European Patent Office, dated Apr. 4, 2001.

* cited by examiner

*Primary Examiner*—Thomas Denion
*Assistant Examiner*—Theresa Trieu
(74) *Attorney, Agent, or Firm*—Baker & Hostetler LLP

(57) ABSTRACT

A stator (1) has a circular cylindrical internal surface (3) delimiting an operating chamber. A rotor (4) is mounted so as to be rotatable about the axis (8) of the internal surface (3) and has a cylindrical external surface (11), with one generatrix (13) adjacent to the internal surface (3), a diametrically opposite generatrix being spaced from the internal surface. A sealing member (17), projecting through a slot in the stator (1) into the operating chamber and being movable substantially radially, has an axial length substantially equal to that of the rotor (4). The sealing member (17) is connected to the rotor (4) by a linkage which causes the radially inner end of the sealing member to closely follow the external surface (3). A shutter disc (6) at one end of the rotor (4) covers a port (14), in particular an inlet port, in the stator (1). The disc (6) has a through-hole with a first end remote from the operating chamber and a second end opening into the operating chamber, the first end periodically overlapping the port (14) as the rotor (4) rotates.

15 Claims, 2 Drawing Sheets

ROTARY POSITIVE DISPLACEMENT MACHINE

FIELD OF THE INVENTION

The present invention relates to rotary positive displacement machines, particularly, but not solely, for use in heat pumps.

BACKGROUND OF THE INVENTION

In conventional small heat pumps no energy is recovered from vapour passing from the condenser to the evaporator.

SUMMARY OF THE INVENTION

It would be desirable to be able to recover energy from fluid between the condenser and the evaporator in a heat pump cycle.

It would also be desirable to provide a machine which allows vapour from the condenser to do work as it expands.

It would also be desirable to provide a machine for performing both compression and expansion.

The invention is based on a rotary positive displacement machine comprising:

- a stator having a circular cylindrical internal surface delimiting an operating chamber, the stator having fluid inlet/outlet ports;
- a rotor in the operating chamber, the rotor being mounted so as to be rotatable relative to the stator about the axis of the said internal surface, the rotor having a cylindrical external surface, the said axis passing through the rotor, a generatrix of the external surface being adjacent to the said internal surface, and a diametrically opposite generatrix being spaced from the said internal surface;
- a sealing member projecting substantially radially through a slot in the stator into the operating chamber and being movable substantially radially, the sealing member extending parallel to the said axis and having a length substantially equal to that of the rotor; and
- means for keeping the radially inner end of the sealing member adjacent the external surface of the rotor.

In one aspect the invention provides a rotary positive displacement machine a set forth in claim 1.

In another aspect the invention provides a rotary positive displacement machine as set forth in claim 11.

BRIEF DESCRIPTION OF THE DRAWINGS

The invention will be described further, by way of example only, with reference to the accompanying drawings, in which.

DESCRIPTION OF THE PREFERRED EMBODIMENT

Figure 1:
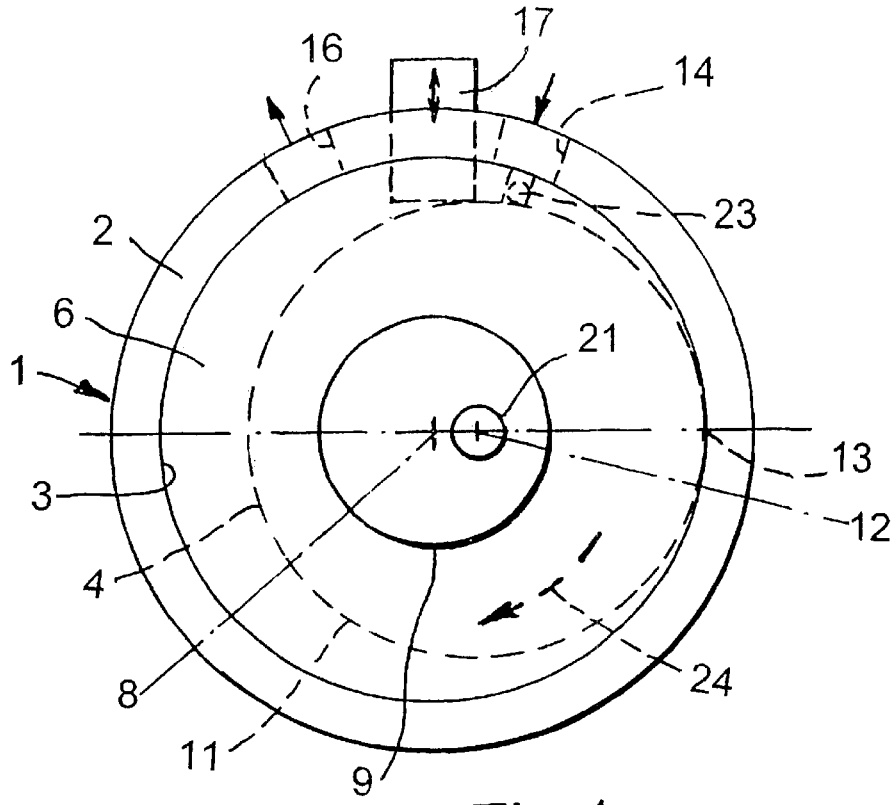
FIG. 1 is a diagrammatic end view of a rotary positive displacement machine, functioning as an expander, certain parts being omitted for the sake of clarity.
Figure 2:
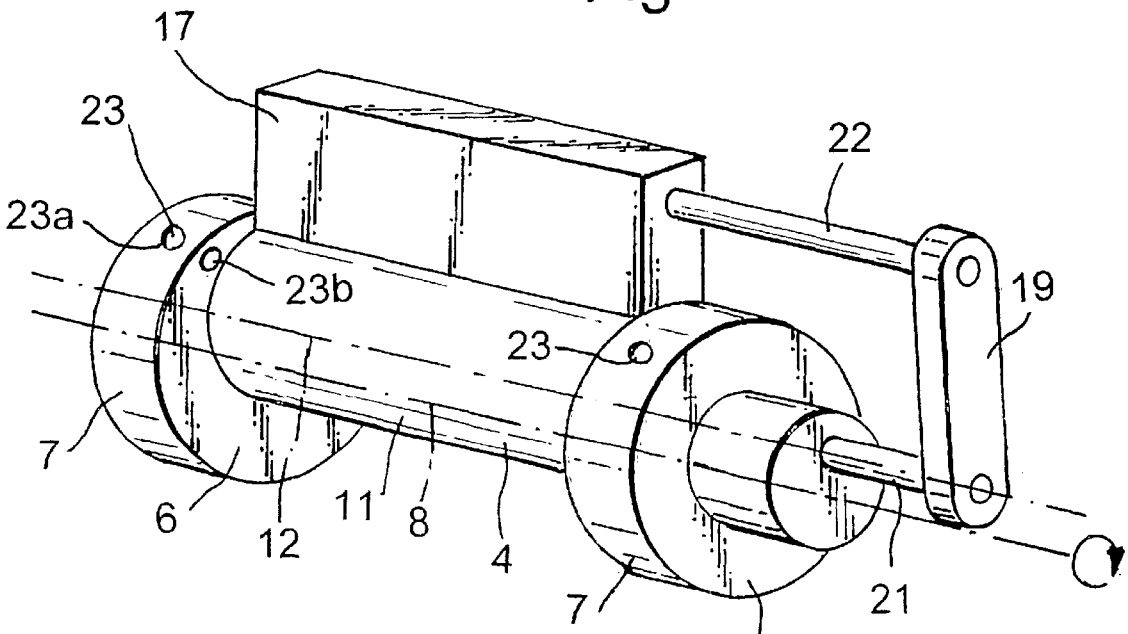
FIG. 2 is a perspective view of a rotor, a sealing member, and associated parts of the machine.
Figure 3:
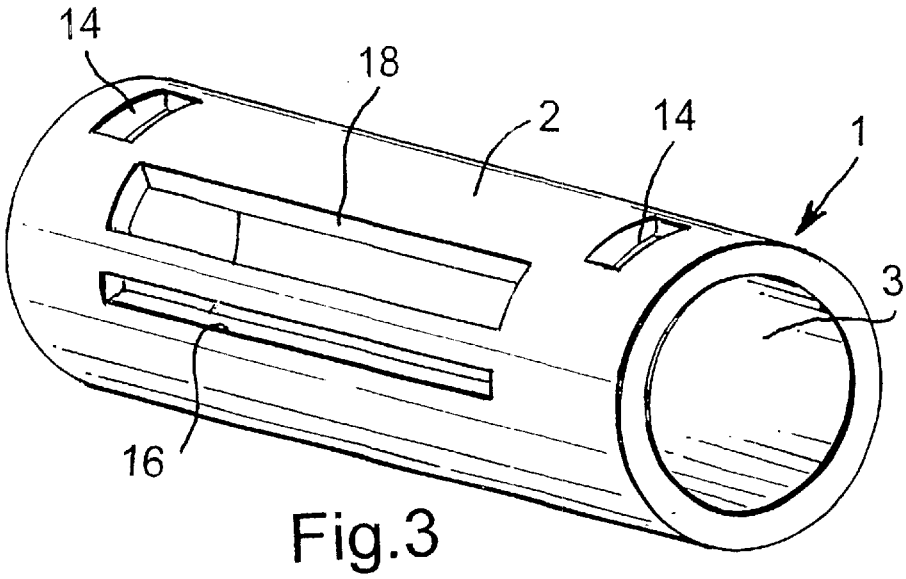
FIG. 3 is a perspective view of the peripheral wall of a stator of the machine.
Figure 4:
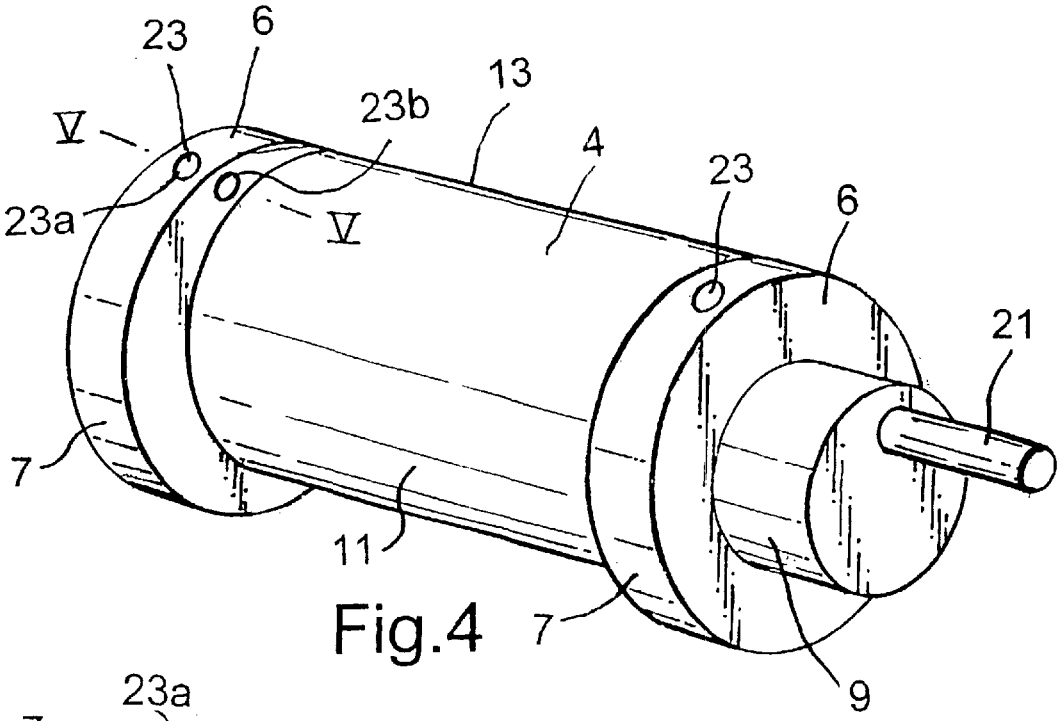
FIG. 4 is a perspective view of the rotor and associated parts.
Figure 5:
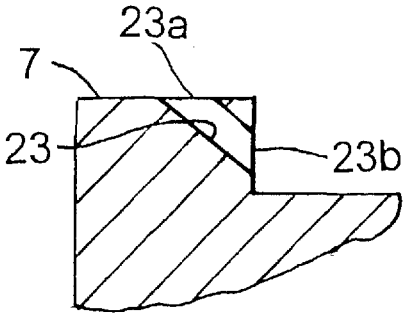
FIG. 5 is a section taken on line V—V in FIG. 4.

The rotary positive displacement machine illustrated has a stator or casing 1 with a peripheral wall 2 having a circular cylindrical internal surface 3. A rotor 4 arranged in the stator 1 is provided at each end with a shutter in the form of a flange or disc 6, having a circular cylindrical periphery 7 with only a small clearance between itself and the internal surface 3. The discs 6 together with the portion of the internal surface 3 extending between them delimit a circular cylindrical operating chamber in which the rotor 4 can orbit about the axis 8 of the internal surface 3. The rotor 4 is provided with trunnions 9 mounted in bearings (not shown) provided on the ends of the stator 1.

The rotor 4 has a circular cylindrical external surface 11 with an axis 12 which is eccentric with respect to the axis 8 of the internal surface 3 of the stator 1. The axis 8 passes through the rotor 4. One generatrix 13 of the external surface 11 (in a plane containing the axes 8, 12) is adjacent to the internal surface 3, with only a small clearance. The diametrically opposite generatrix is spaced from the internal surface 3.

In the region of each disc 6 and at the same circumferential location, the stator 1 has an inlet port 14 in the form of a slot extending along a circumferential arc. In the region of the operating chamber at a circumferential location spaced from the inlet ports 14, the stator 1 has an outlet port 16 in the form of an axial slot. Between the ports 14 and 16, and close to them, is a sealing member 17 which projects radially through a slot 18 in the stator 1 so as to be movable in the radial direction with respect to the axis 8. The sealing member 17 extends parallel to the axis 8 and has a length substantially equal to that of the rotor 4, with only a small clearance between the ends of the sealing member 17 and the discs 6.

In order to keep the radially inner end of the sealing member 17 adjacent to the external surface 11 of the rotor 4, without excessive friction, a link 19 (functioning as a connecting rod) has one end articulated to a pin 21 forming an extension of the rotor 4 on a first articulation axis coincident with the axis 12 and has the other end articulated to a parallel pin 22 mounted on one end of the sealing member 17 and defining a second articulation axis parallel to the first. In conjunction with the radially guiding of the sealing member 17 by the walls of the slot 18, this linkage (19, 21, 22) causes the inner end of the sealing member 17 to closely follow the external surface 11 of the rotor 4 as it rotates about the axis 8. For balanced operation, a similar linkage may be provided on the opposite end of the machine.

Each disc 6 has an inlet through-hole 23 with a first end 23*a* in the periphery 7 and a second end 23*b* opening into the operating chamber. Thus, the inlet port 14 only communicates with the operating chamber when the first end 23*a* overlaps the inlet port 14; otherwise the inlet port 14 is blanked off by the disc 6.

The above-described machine can be arranged as an expander in a heat pump (not shown) comprising a compressor, a condenser, an expander, and an evaporator, connected in series. Return vapour from the condenser is fed to the input ports 14. The circumferential length of the slots constituting the ports 14 is chosen to suit the length of time needed for the through-holes 23 to pass a required volume of vapour. Referring to FIG. 1, the pressure of the vapour from the through-hole 23, acting on the rotor 4 between the sealing member 17 and the generatrix 13, urges the rotor 4 to turn in the direction of the arrow 24, while the vapour expands as the rotor rotates through nearly 360°. At the same time, previously expanded vapour is driven out through the outlet port 16.

It will be appreciated that the machine may be used as a compressor. Furthermore, the machine can operate on fluids other than refrigerants, e.g. vapours and gases, in particular air.

A combined compressor and expander may comprise two stators fixed end-to-end and having a common axis, and two rotors operatively connected to rotate in synchronism.

The skilled reader will appreciate that various modifications may be made within the scope of the invention. For instance, one of the discs may be omitted and the end of the stator closed off by a fixed wall delimiting one end of the operating chamber. The sealing member may be urged into contact with the rotor by a spring device, instead of using the linkage. The rotor could be of any suitable cylindrical shape. An outlet port may be opened and closed by a through-hole in one of the discs in a similar way to the inlet port.

What is claimed is:

1. A rotary positive displacement machine comprising:

a stator having a circular cylindrical internal surface delimiting an operating chamber, the stator having fluid inlet/outlet ports;

a rotor in the operating chamber, the rotor being mounted so as to be rotatable relative to the stator about the axis of the said internal surface, the rotor having a cylindrical external surface, the said axis passing through the rotor, a generatrix of the external surface being adjacent to the said internal surface, and a diametrically opposite generatrix being spaced from the said internal surface;

a sealing member projecting substantially radially through a slot in the stator into the operating chamber and being movable substantially radially, the sealing member extending parallel to the said axis and having a length substantially equal to that of the rotor;

means for keeping the radially inner end of the sealing member adjacent the external surface of the rotor; and a shutter at one end of the rotor, the shutter rotating with the rotor and having a circular cylindrical external surface covering one of the said ports, the said one port opening in the circular cylindrical internal surface of the stator, the shutter having a through-hole with a first end in the circular cylindrical external surface and a second end opening into the operating chamber, the first end periodically overlapping the said one port as the rotor rotates relative to the stator.

2. A rotary positive displacement machine as claimed in claim 1, in which the external surface of the rotor is circular cylindrical.

3. A rotary positive displacement machine as claimed in claim 2, in which the sealing member is connected to the rotor by a linkage which causes the radially inner end of the sealing member to closely follow the said external surface.

4. A rotary positive displacement machine as claimed in claim 3, in which the linkage comprises a link having one end articulated to an extension of the rotor on a first articulation axis coincident with the axis of the said external surface and the other end articulated to the sealing member on a second articulation axis parallel to the first.

5. A rotary positive displacement machine as claimed in claim 1, in which the shutter is in the form of a disc.

6. A rotary positive displacement machine as claimed in claim 1, in which the said one port is in the form of a slot extending along a circumferential arc relative to the axis of the said internal surface.

7. A rotary positive displacement machine as claimed in claim 1, in which there is a shutter on each end of the rotor.

8. A rotary positive displacement machine as claimed in claim 1, in which another of the said ports is in permanent communication with the operating chamber.

9. A rotary positive displacement machine as claimed in claim 1, in which the inlet/outlet ports are adjacent the sealing member.

10. A rotary positive displacement machine comprising:

a stator having a circular cylindrical internal surface delimiting an operating chamber, the stator having fluid inlet/outlet ports;

a rotor in the operating chamber, the rotor being mounted so as to be rotatable relative to the stator about the axis of the said internal surface, the rotor having a circular cylindrical external surface, the said axis passing through the rotor, a generatrix of the external surface being adjacent to the said internal surface, and a diametrically opposite generatrix being spaced from the said internal surface;

a sealing member projecting substantially radially through a slot in the stator into the operating chamber and being movable substantially radially, the sealing member extending parallel to the said axis and having a length substantially equal to that of the rotor;

a linkage for keeping the radially inner end of the sealing member adjacent the external surface of the rotor which causes the radially inner end of the sealing member to closely follow the said external surface, said linkage comprising a link having one end articulated to an extension of the rotor on a first articulation axis coincident with the axis of the said external surface and the other end articulated to the sealing member on a second articulation axis parallel to the first; and a shutter at one end of the rotor, the shutter rotating with the rotor and having a periphery covering one of the said ports, the said one port opening in the circular cylindrical internal surface, the shutter having a through-hole with a first end in the periphery and a second end opening into the operating chamber, the first end periodically overlapping the said one port as the rotor rotates relative to the stator.

11. A rotary positive displacement machine as claimed in claim 10, in which the shutter is in the form of a disc.

12. A rotary positive displacement machine as claimed in claim 10, in which the said one port is in the form of a slot extending along a circumferential arc relative to the axis of the said internal surface.

13. A rotary positive displacement machine as claimed in claim 10, in which there is a shutter on each end of the rotor.

14. A rotary positive displacement machine as claimed in claim 10, in which another of the said ports is in permanent communication with the operating chamber.

15. A rotary positive displacement machine as claimed in claim 10, in which the inlet/outlet ports are adjacent the sealing member.

* * * * *